US008111206B2

(12) United States Patent
Lee et al.

(10) Patent No.: US 8,111,206 B2
(45) Date of Patent: Feb. 7, 2012

(54) HIGH ELECTROMAGNETIC TRANSMISSION COMPOSITE STRUCTURE

(75) Inventors: Cheng-Ching Lee, Daya Township, Taichung County (TW); Jiunn-Shyong Lin, Taichung (TW); Shin-Hon Chen, Taoyuan (TW); Yie-Fan King, Taichung (TW); Dar-Chuen Lin, Lugu Township, Nantou County (TW)

(73) Assignee: Chung-Shan Institute of Science and Technology, Armaments Bureau, Ministry of National Defense, Taoyuan County (TW)

( * ) Notice: Subject to any disclaimer, the term of this patent is extended or adjusted under 35 U.S.C. 154(b) by 390 days.

(21) Appl. No.: 12/551,323

(22) Filed: Aug. 31, 2009

(65) Prior Publication Data

US 2011/0050370 A1 Mar. 3, 2011

(51) Int. Cl.
*H01Q 1/42* (2006.01)

(52) U.S. Cl. ..... 343/872; 438/66

(58) Field of Classification Search ..... 343/872, 343/700 MS; 333/202, 219, 219.1; 438/66
See application file for complete search history.

(56) References Cited

U.S. PATENT DOCUMENTS

| | | | | |
|---|---|---|---|---|
| 6,028,565 | A * | 2/2000 | Mackenzie et al. | 343/872 |
| 6,992,640 | B2 * | 1/2006 | Usami et al. | 343/872 |
| 7,256,746 | B2 * | 8/2007 | Kamiya et al. | 343/713 |
| 7,280,009 | B2 * | 10/2007 | Reynolds et al. | 333/202 |

* cited by examiner

*Primary Examiner* — Hoang V Nguyen

(57) ABSTRACT

The invention discloses a high electromagnetic transmission composite structure for reducing the transmission loss of an electromagnetic wave. The high electromagnetic transmission composite structure includes a first composite structure layer, a second composite structure layer, and a first buffer layer. The first composite structure layer has a first thickness and a first dielectric constant. The second composite structure layer has a second thickness and a second dielectric constant. The first buffer is disposed between the first composite structure layer and the second composite structure layer and has a third thickness and a third dielectric constant. The transmission loss of the electromagnetism wave can be adjusted by adjusting the first thickness, the first dielectric constant, the second thickness, the second dielectric constant, the third thickness, and the third dielectric constant.

13 Claims, 4 Drawing Sheets

HIGH ELECTROMAGNETIC TRANSMISSION COMPOSITE STRUCTURE

BACKGROUND OF THE INVENTION

1. Field of the Invention

The present invention generally relates to a high electromagnetic transmission composite structure, and more particularly, to a multi-layer composite structure to decrease the transmission loss efficiency and increase the strength of the structure.

2. Description of the Prior Art

With the development of technology, technologies and applications of the radar also continually are renovated. "RADAR" is transliterating in English, it is the abbreviation of Radio Detection And Ranging, and its original meaning is the wireless exploration and range finding.

However, there are various kinds of radars, and the method of classifying radars is also very complicated. Usually, the radars can be classified into the type for general applications or the type for martial or science research purposes. For example, the general applications comprise management in airport and harbor, weather forecast, and astronomy research; the martial applications comprise hunting and guiding, tracking survey and fire control, identifying whether it is a friend or a foe, downward view, downward shoot and the surveying and drawing navigation of a fighter.

The fundamental theory of the radar is to transmit an electromagnetic wave to a target, and the target will be discovered if a returned wave, a forwarding wave, or a self-radiation of the electromagnetic wave from the target is received, through which the position, velocity, shape, gyrate, or other parameters of the target from the received signal can be retrieved, so that the information on the distance from the target to the radar, the distance variation rate (radial velocity), the position, the altitude will be obtained accordingly. The advantage of the radar is that the radar can measure a distant and small target no matter it is in the daytime or night, and will not be blocked by fog, cloud, or rain.

However, there are various types of energy existing in the space, such as voice, light, and electromagnetic wave. All these types of energy have a common characteristic that if the energy is stronger, the transmitting distance of the energy will be farther. For example, in order to detect the distant target, the general power range of the radar transmitter is 100,000 to 1,000,000 watts, but most energy of the radar signal will be lost in the transmitting process, only a small part of energy of the radar signal can reach the target and the radar signal will be reflected back by the target. And the reflected energy of the reflected signal will be lost again in the transmitting process before it is received by the antenna of the radar, the received signal usually has an energy of 10 to 12 pico-watts only.

Furthermore, the loss of the energy of the electromagnetic wave in the transmitting process can be classified in two types: spreading and absorption. The spreading relates to the transmitting distance, because the electromagnetic wave energy and the disseminating distance square are in reverse proportion. If the transmitting distance is longer, the loss of the electromagnetic wave energy caused by spreading will become more serious. As to the absorption, the absorption relates to natural environment factors such as rainfall, oxygen and steam in the air. Especially, when the rainfall is higher, the electromagnetic wave energy will be absorbed critically. The loss of electromagnetic wave energy is formed according to the oxygen and steam in the air.

Above all, the transmitting energy of the electromagnetic wave will be affected by many factors. Therefore, the radar device is located in an outdoor environment, so that the electromagnetic wave emitted from the radar device will not be blocked by the shelter and causes greater loss. However, in order to reduce the damage of the radar device caused by exposing the radar device in outdoor environment (e.g., rainfall or gale) for a long period of time, a protection structure is usually disposed on the periphery or the outside of the radar device, and it is also called the radome.

However, when the electromagnetic wave emitted by the radar passes through an object, the energy power of the electromagnetic wave will be decreased. Therefore, although the radome can protect the radar device from being damaged by environment influence, the electromagnetic wave emitted by the radar will still be influenced by the radome, so that the detecting efficiency and the judgment accuracy of the radar device will be affected.

Therefore, the high electromagnetic transmission composite structure of the invention uses the multi-layer assembly method to decrease the transmission loss effectively and make the effective operating frequency wider. And, since the high electromagnetic transmission composite structure of the invention has stronger structural strength, it can be widely used in various kinds of radome.

SUMMARY OF THE INVENTION

Accordingly, the invention discloses a high electromagnetic transmission composite structure for reducing the transmission loss of an electromagnetic wave. The high electromagnetic transmission composite structure comprises a first composite structure layer, a second composite structure layer, and a first buffer layer.

The first composite structure layer has a first thickness and a first dielectric constant. The second composite structure layer has a second thickness and a second dielectric constant. The first buffer is disposed between the first composite structure layer and the second composite structure layer, and had a third thickness and a third dielectric constant. Specifically, the transmission loss of the electromagnetism wave can be adjusted by adjusting the first thickness, the first dielectric constant, the second thickness, the second dielectric constant, the third thickness, and the third dielectric constant.

Compared to the prior art, the method of the multi-layer assembly is used in the high electromagnetic transmission composite structure of the invention to decrease the transmission loss effectively and make the effective operating frequency wider. And, since the high electromagnetic transmission composite structure of the invention has stronger structural strength, it can be widely used in various kinds of radome.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

DETAILED DESCRIPTION OF THE INVENTION

Figure 1A:
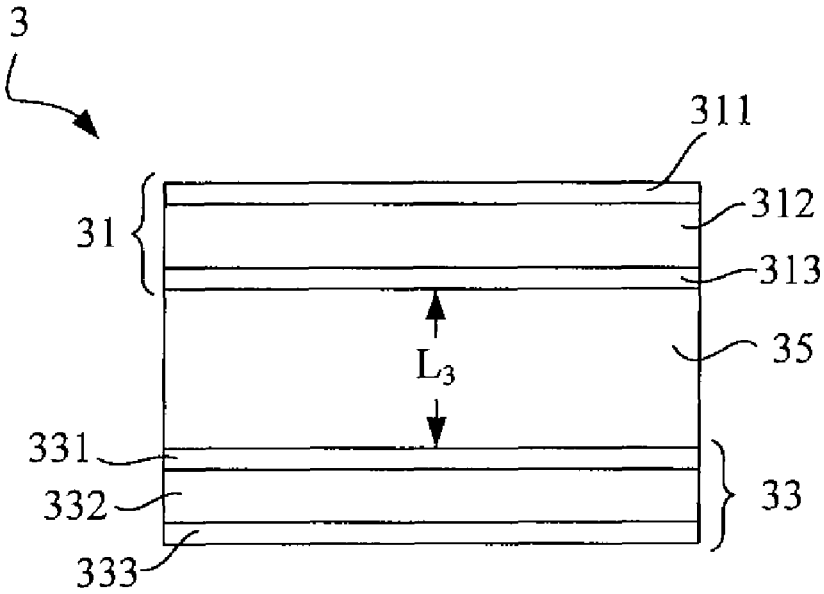
FIG. 1A illustrates a schematic diagram of the high electromagnetic transmission composite structure of an embodiment of the invention.

Please refer to FIG. 1A. FIG. 1A illustrates a schematic diagram of the high electromagnetic transmission composite structure 3 of an embodiment of the invention. As shown in FIG. 1A, the high electromagnetic transmission composite structure 3 of the invention comprises a first composite structure layer 31, a second composite structure layer 33, and a first buffer layer 35.

Figure 1B:
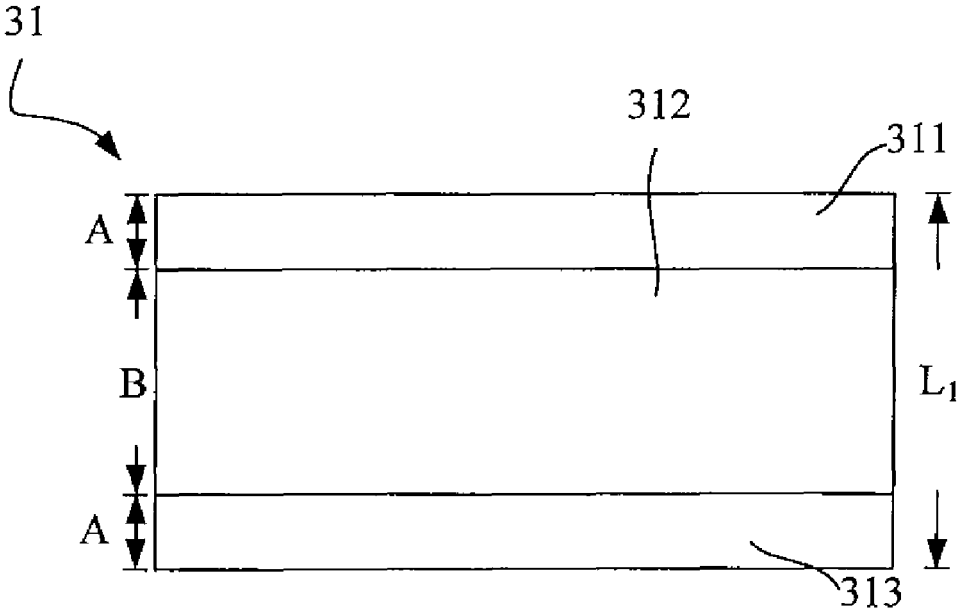
FIG. 1B illustrates an amplifying schematic diagram of the first composite structure layer in FIG. 1A.

Please refer to FIG. 1B. FIG. 1B illustrates an amplifying schematic diagram of the first composite structure layer 31 in FIG. 1A. As shown in FIG. 1B, the first composite structure layer 31 includes a first composite board 311, a second composite board 313 and a second buffer layer 312. The first composite board 311 has a thickness A and a dielectric constant $E_1$. The second composite board 313 has the thickness A and the dielectric constant $E_1$ and the first composite board 311 are the same. The second buffer layer 312 has a thickness B and a dielectric constant $E_2$.

Additionally, the first thickness $L_1$ of the first composite structure layer 31 is formed by superposing the thickness A of the first composite board 311, the thickness A of the second composite board 313 and the thickness B of the second buffer layer 312. In this embodiment, defining that the first composite structure layer 31 comes with a first dielectric constant $\in_1$, and the first dielectric constant $\in_1$ is determined by the dielectric constants $E_1$ and $E_2$ of the first composite board 311, the second composite board 313 and the second buffer layer 312. Specifically, the first composite board 311 and the second composite board 313 are formed by glass fiber or quartz fiber mixing with resin (for example, phenplic resin, PMI resin, or epoxy resin), but not limited to this. Additionally, the second buffer layer 312 is not limited to the material category specifically. For example, the second buffer layer 312 can be a visible paper honeycomb structure, a PU foaming material, or invisible air, etc. It should be specially emphasized that the second buffer layer 312 is used to keep the suitable distance between the first composite board 311 and the second composite board 313.

The second composite structure layer 33 includes a third composite board 331, a fourth composite board 333, and a third buffer layer 332. Specifically, in this embodiment, since the second composite structure layer 33 is the same with the first composite structure layer 31, there is not need to introduce the structure characteristic of the second composite structure layer 33 again. However, there is still the need to define that the second composite structure layer 33 comes with a second thickness $L_2$ and the second dielectric constant $\in_2$. In this embodiment, the second thickness $L_2$ equals to the first thickness $L_1$, and the second dielectric constant $\in_2$ equals to the first dielectric constant $\in_1$. Of course, in practical applications, it will not be specifically limited herein, the second thickness $L_2$ and the second dielectric constant $\in_2$ of the second composite structure layer 33 can be designed by the technologist in this region according to the practical needs or the design limitations, and the second thickness $L_2$ and the second dielectric constant $\in_2$ of the second composite structure layer 33 do not have to be the same with those of the first composite structure layer 31. Similarly, the material of the third buffer layer 332 is not limited, for example, the third buffer layer 332 can be a visible paper honeycomb structure, a PU foaming material, or invisible air, etc. It should be specially emphasized that the third buffer layer 332 is used to separate the suitable distance between the third composite board 331 and the fourth composite board 333.

Additionally, in the manufacturing process of the above-mentioned first composite board 311, second composite board 313, third composite board 331, and fourth composite board 333, a pre-preg or a wet lay-up can be used to finish the thickness stacking manufacture, and then a vacuum pressurizing method can be used to finish the manufacturing process. The forming temperature depends on the choice of the resin category in the manufacturing process. Specifically, the above-mentioned manufacturing method is only a case of the manufacturing process, but not limited to this case.

The first buffer layer 35 can be made by a PU foaming material or a paper honeycomb structure, but not limited herein. And, the first buffer layer 35 comes with a third thickness $L_3$ and a third dielectric constant $\in_3$ which is disposed between the first composite structure layer 31 and the second composite structure layer 33.

Specifically, the structural strength of the high electromagnetic transmission composite structure 3 of the invention can be adjusted by designing the thickness of the first composite structure layer 31, the second composite structure layer 33, and the first buffer layer 35.

The various important component materials and characteristics, the connecting relationship in the high electromagnetic transmission composite structure 3 of the invention have been described in details above. Then, the working theorem and function of the high electromagnetic transmission composite structure 3 in practical applications will be described in details below.

Figure 2:
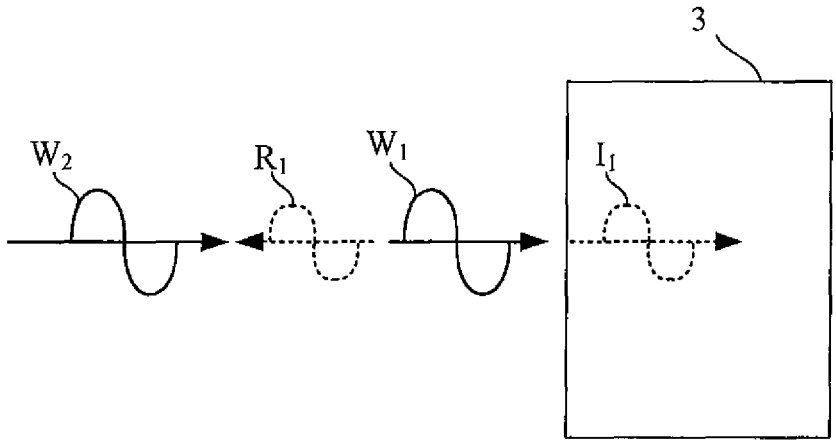
FIG. 2 illustrates a schematic diagram of the high electromagnetic transmission composite structure of the invention in the practical application.

Please refer to FIG. 2. FIG. 2 illustrates a schematic diagram of the high electromagnetic transmission composite structure 3 of the invention in practical application. As shown in FIG. 2, when the electromagnetic wave $W_1$ of the fist cycle is emitted toward the high electromagnetic transmission composite structure 3 of the invention, and when the electromagnetic wave $W_1$ of the fist cycle touched the high electromagnetic transmission composite structure 3 of the invention, the electromagnetic wave $W_1$ will be separated to form an incident wave $I_1$ and a reflected wave $R_1$. The incident wave $I_1$ is incorporated into the high electromagnetic transmission composite structure 3 of the invention, it can continually transmit forward. But the reflected wave $R_1$ can perform the reflected motion opposite to the direction of the incident wave $I_1$ approximately.

As well, according to the well-known electromagnetic wave theory of the prior art in this technological region, if the reflected wave $R_1$ and the next cycle transmitted the electromagnetic wave $W_2$ are in constructive interference, the resultant wave amplitude formed via the electromagnetic wave $W_2$ and the reflected wave $R_1$ will be larger then the electromagnetic wave $W_2$. On the contrary, if the reflected wave $R_1$ and the next cycle transmitted the electromagnetic wave $W_2$ are in destructive interference, the resultant wave amplitude formed via the electromagnetic wave $W_2$ and the reflected wave $R_1$ will be less then the electromagnetic wave $W_2$.

$$0.5N = \frac{L_1}{\lambda_0/\sqrt{\varepsilon_1}} + \frac{L_2}{\lambda_0/\sqrt{\varepsilon_2}} + \frac{L_3}{\lambda_0/\sqrt{\varepsilon_3}} \quad (1.1)$$

Please refer to the equation (1.1). As shown in the equation (1.1), N is a random odd number. $L_1$ is the total thickness of the first composite structure layer 31 formed by superimposing the thickness A of the first composite board 311, the thickness A of the second composite board 313, and the thickness B of the second buffer layer 312. $\in_1$ is a dielectric constant of the first composite structure layer 31. $L_2$ is the total thickness of the second composite structure layer 33 formed by superimposing the third composite board 331, the fourth composite board 333, and the third buffer layer 332. $\in_2$ is a dielectric constant of the second composite structure layer 33. $L_3$ is a thickness of the first buffer layer 35. $\in_3$ is a dielectric constant of the first buffer layer 35. It should be emphasized again, in this embodiment, the structure layer, the thickness, and the dielectric constant of the first composite structure layer 31 and the second composite structure layer 33 are the same, but the second thickness $L_2$ and the dielectric constant $\in_2$ of the second composite structure layer 33 can be suitably adjusted according to the user's needs. In other words, as long as the equation (1.1) is conformed, the structure layer, the thickness, and the dielectric constant of the first composite structure layer 31 and those of the second composite structure layer 33 can be different.

Therefore, according to the equation (1.1), the high electromagnetic transmission composite structure 3 of the invention adjusts the material parameters (e.g., the thickness and the dielectric constant) of the first composite board 311, the second composite board 313, and the second buffer layer 312 of the first composite structure layer 31, and the material parameters (e.g., the thickness and the dielectric constant) of the third composite board 331, the fourth composite board 333, the third buffer layer 332 of the second composite structure layer 33, the third thickness $L_3$, and the dielectric constant $\in_3$ of the first buffer layer 35.

In this embodiment, if the material parameters designed in the high electromagnetic transmission composite structure 3 satisfies the equation (1.1), the reflected wave $R_1$ and the next cycle transmitted the electromagnetic wave $W_2$ will approximately be in constructive interference, so that the amplitude of the resultant wave formed via the electromagnetic wave $W_2$ and the reflected wave $R_1$ will be larger then the amplitude of the original electromagnetic wave $W_2$. Therefore, when the amplitude of the electromagnetic wave $W_2$ is increased, the penetration of the electromagnetic wave $W_2$ is also increased relatively, that is to say, the transmission loss effect will be reduced accordingly.

The comparison of the transmitting loss results of the electromagnetic waves corresponding to the different thicknesses of the high electromagnetic transmission composite structure 3 of the invention will be discussed as follows.

Figure 3A:
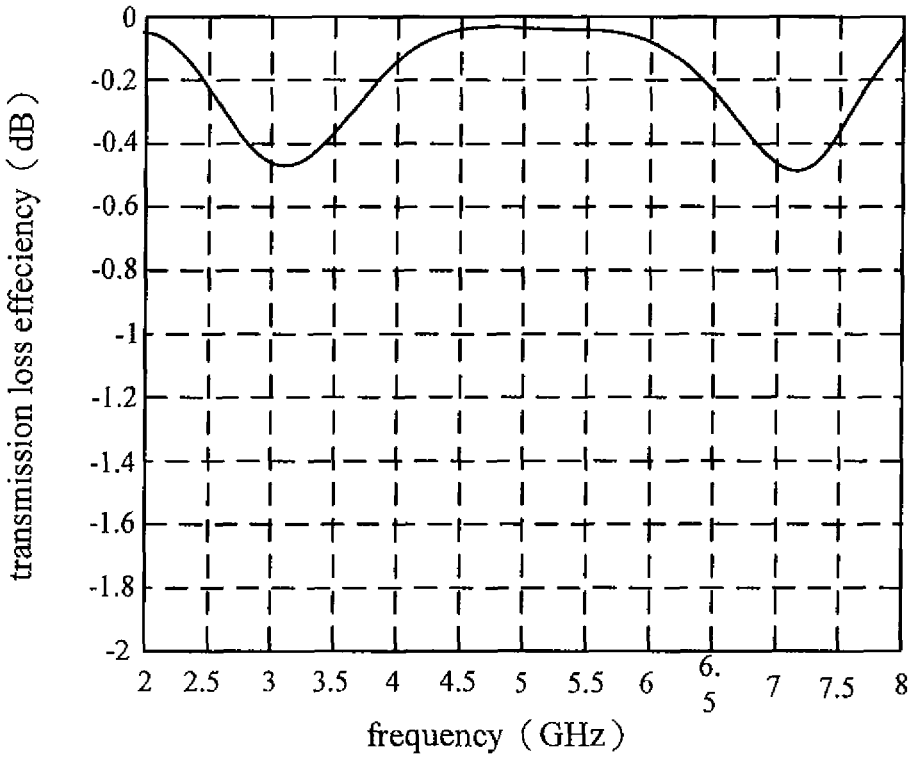
FIG. 3A illustrates an analyzed result of the high electromagnetic transmission composite structure of the first embodiment of the invention.

Please refer to FIG. 3A. FIG. 3A illustrates the analyzed result of the high electromagnetic transmission composite structure 3 of the first embodiment of the invention. As shown in FIG. 3A, in the high electromagnetic transmission composite structure 3 of the invention in this embodiment, the thicknesses of the material layers are as follows: The thicknesses of the first composite board 311, the second composite board 313, the third composite board 331, and the fourth composite board 333 are all 1 mm, while the thicknesses of the first buffer layer 35, the second buffer layer 312, and the third buffer layer 332 are 30 mm, 10 mm, and 10 mm, respectively.

Figure 3B:
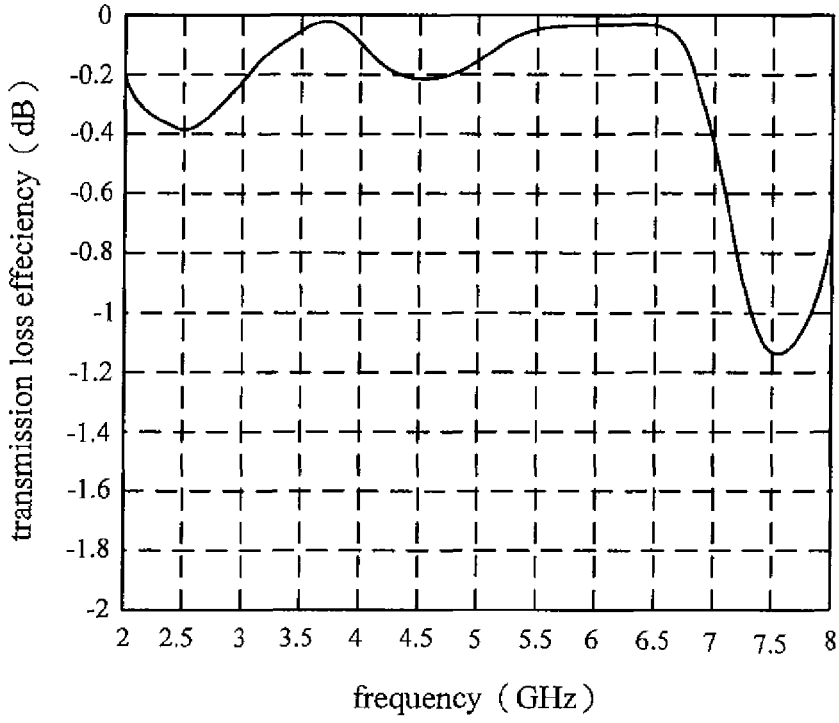
FIG. 3B illustrates an analyzed result of the high electromagnetic transmission composite structure of the second embodiment of the invention.

Please refer to FIG. 3B. FIG. 3B illustrates an analyzed result of the high electromagnetic transmission composite structure 3 of the second embodiment of the invention. As shown in FIG. 3B, in the high electromagnetic transmission composite structure 3 of the invention in this embodiment, the thicknesses of the material layers are as follows: The thicknesses of the first composite board 311, the second composite board 313, the third composite board 331, and the fourth composite board 333 are all 1 mm, while the thicknesses of the first buffer layer 35, the second buffer layer 312, and the third buffer layer 332 are 45 mm, 10 mm, and 10 mm, respectively.

Figure 3C:
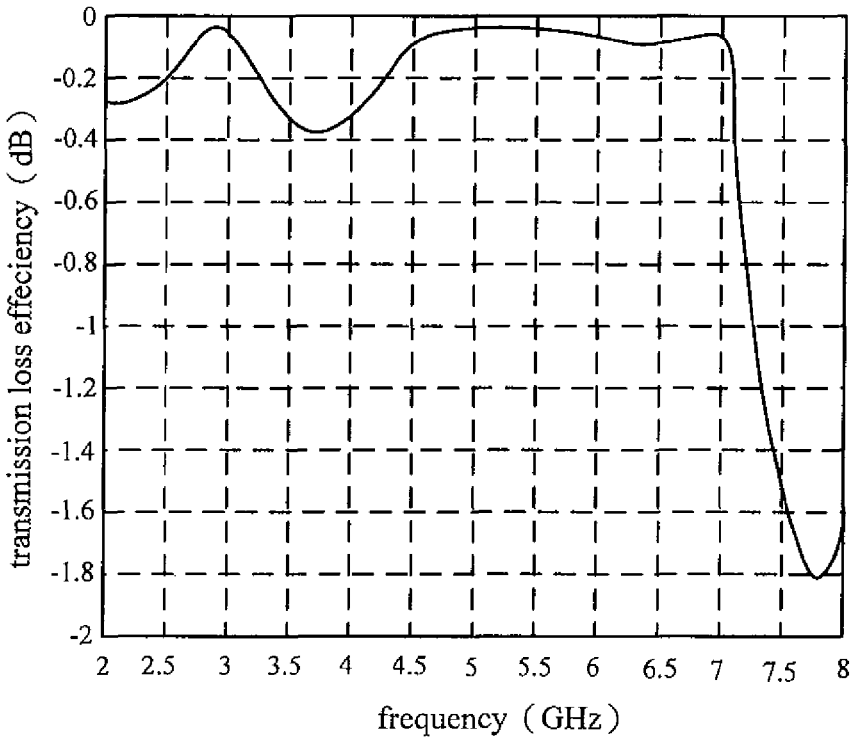
FIG. 3C illustrates an analyzed result of the high electromagnetic transmission composite structure of the third embodiment of the invention.

Please refer to FIG. 3C. FIG. 3C illustrates an analyzed result of the high electromagnetic transmission composite structure 3 of the third embodiment of the invention. As shown in FIG. 3C, in the high electromagnetic transmission composite structure 3 of the invention in this embodiment, the thicknesses of the material layers are as follows: The thicknesses of the first composite board 311, the second composite board 313, the third composite board 331, and the fourth composite board 333 are all 1 mm, while the thicknesses of the first buffer layer 35, the second buffer layer 312, and the third buffer layer 332 are 60 mm, 10 mm, and 10 mm, respectively.

Figure 3D:
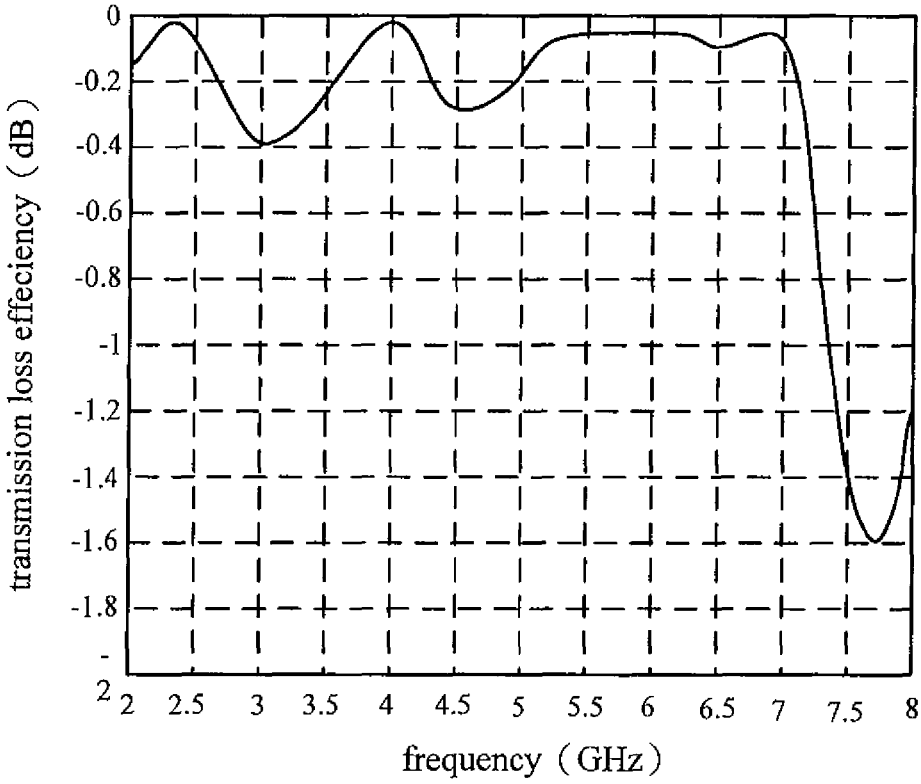
FIG. 3D illustrates an analyzed result of the high electromagnetic transmission composite structure of the fourth embodiment of the invention.

Please refer to FIG. 3D. FIG. 3D illustrates an analyzed result of the high electromagnetic transmission composite structure 3 of the fourth embodiment of the invention. As shown in FIG. 3D, in the high electromagnetic transmission composite structure 3 of the invention in this embodiment, the thicknesses of the material layers are as follows: The thicknesses of the first composite board 311, the second composite board 313, the third composite board 331, and the fourth composite board 333 are all 1 mm, while the thicknesses of the first buffer layer 35, the second buffer layer 312, and the third buffer layer 332 are 80 mm, 10 mm, and 10 mm, respectively.

From the above-mentioned analyzed results, it can be found that the transmission loss efficiencies in the scope of C band (i.e. the working frequency range of 4 GHz to 6 GHz) will be different corresponding to different thickness conditions. Therefore, the high electromagnetic transmission composite structure 3 of the invention can control the transmission loss efficiency of the electromagnetic wave by adjusting the material parameter (e.g., the thickness or the dielectric constant) of each layer. In other words, the material parameters of the layers can be adjusted to control the reflected wave $R_1$ and the electromagnetic wave $W_2$ in constructive interference mutually. Moreover, the high electromagnetic transmission composite structure 3 of the invention can also change the material of the composite board or the buffer layer to change the dielectric constant of the different material, so that the transmission loss efficiency can be also changed according to the dielectric constant of the different material.

Figure 4:
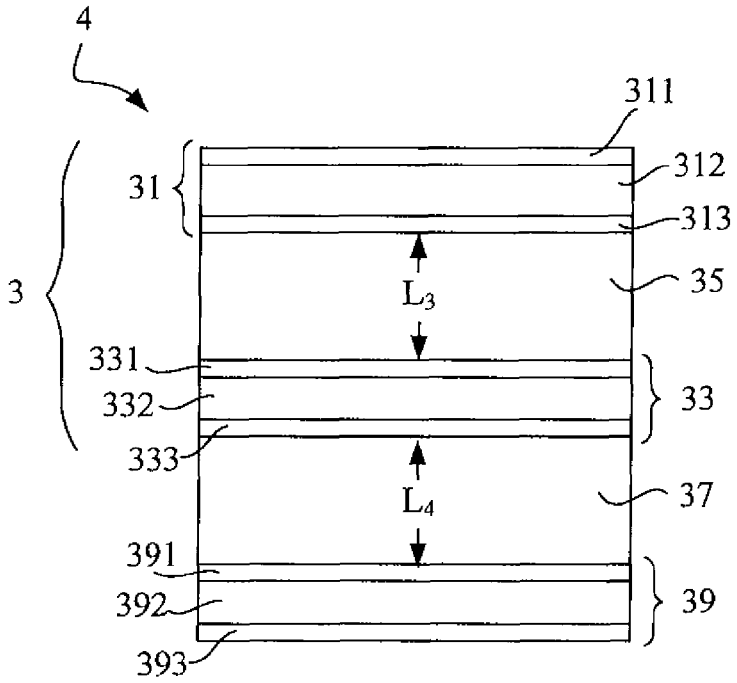
FIG. 4 illustrates a schematic diagram of the high electromagnetic transmission composite structure of another embodiment of the invention.

Please refer to FIG. 4. FIG. 4 illustrates a schematic diagram of the high electromagnetic transmission composite structure 4 of another embodiment of the invention. As shown in FIG. 4, the fourth buffer layer 37 and the third composite structure layer 39 can be added to the above-mentioned high electromagnetic transmission composite structure 3 to form the high electromagnetic transmission composite structure 4. In this embodiment, a dielectric constant $\in_4$ and a fourth thickness $L_4$ of the fourth buffer layer 37 can be the same with the third thickness $L_3$ of the first buffer layer 35. The properties of the fifth composite board 391, the fifth buffer layer 392, and the sixth composite board 393 of the third composite structure layer 39 can be also the same with the first composite structure layer 31 and/or the second composite structure layer 33, so there is no need to describe it here again. The only thing should be emphasized is that the invention has various states, but not limited to the above-mentioned embodiments. In other words, as long as the equation (1.1) is conformed, the structure layer, the thickness, and the dielectric constant of the third composite structure layer 39 and the first composite structure layer 31 and/or the second composite structure layer 33 can also be different.

Compared to the prior art, the high electromagnetic transmission composite structure of the invention mutually assembles the different material layers, and adjusts the acting module of the reflected wave by designing the material parameter of each layer. In short, the constructive interference is generated by the reflected wave and the next incident wave mutually interfered through the high electromagnetic transmission composite structure of the invention, to increase the amplitude of the opposite resultant wave. In other words, the above-mentioned result has decreased the transmission loss efficiency. Additionally, the wider effective working frequency is also a practical benefit of the invention. And, the high electromagnetic transmission composite structure of the invention can intensify the strength structure by adjusting the first composite structure layer, the second composite structure layer, and the thickness of the first buffer layer, so that the invention can be widely used to various kinds of radome.

Although the present invention has been illustrated and described with reference to the preferred embodiment thereof, it should be understood that it is in no way limited to the details of such embodiment but is capable of numerous modifications within the scope of the appended claims.

What is claimed is:

1. A high electromagnetic transmission composite structure, for reducing a transmission loss of an electromagnetic wave, the high electromagnetic transmission composite structure comprising:

a first composite structure layer having a first thickness and a first dielectric constant;

a second composite structure layer having a second thickness and a second dielectric constant; and a first buffer layer, disposed between the first composite structure layer and the second composite structure layer, having a third thickness and a third dielectric constant;

wherein the transmission loss of the electromagnetism wave can be adjusted by adjusting the first thickness, the first dielectric constant, the second thickness, the second dielectric constant, the third thickness, and the third dielectric constant.

2. The high electromagnetic transmission composite structure of claim 1, wherein the first composite structure layer comprises:

a first composite board;

a second composite board; and a second buffer layer disposed between the first composite board and the second composite board;

wherein the first thickness and the first dielectric constant are determined by the material parameters of the first composite board, the second buffer layer, and the second composite board.

3. The high electromagnetic transmission composite structure of claim 2, wherein the material parameters comprise the thickness and the dielectric constant.

4. The high electromagnetic transmission composite structure of claim 2, wherein the first composite board and the second composite board are formed by the glass fiber or the quartz fiber mixing with the resin.

5. The high electromagnetic transmission composite structure of claim 4, wherein the resin is a phenolic resin, a PMI resin, or an epoxy resin.

6. The high electromagnetic transmission composite structure of claim 2, wherein the second buffer layer is made by a PU foaming material or a paper honeycomb structure.

7. The high electromagnetic transmission composite structure of claim 1, wherein the second composite comprises:

a third composite board;

a fourth composite board; and a third buffer layer disposed between the third composite board and the fourth composite board;

wherein the second thickness and the second dielectric constant are determined by the material parameters of the third composite board, the third buffer layer, and the fourth composite board.

8. The high electromagnetic transmission composite structure of claim 7, wherein the material parameters comprise the thickness and the dielectric constant.

9. The high electromagnetic transmission composite structure of claim 7, wherein the third composite board and the fourth composite board are formed by the glass fiber or the quartz fiber mixing with the resin.

10. The high electromagnetic transmission composite structure of claim 9, wherein the resin is a phenolic resin, a PMI resin, or an epoxy resin.

11. The high electromagnetic transmission composite structure of claim 7, wherein the second buffer layer is made by a PU foaming material or a paper honeycomb structure.

12. The high electromagnetic transmission composite structure of claim 1, wherein the second composite structure layer is the same with the first composite structure layer.

13. The high electromagnetic transmission composite structure of claim 1, wherein the first buffer layer is made by a PU foaming material or a paper honeycomb structure.

* * * * *